United States Patent [19]

Otsuki et al.

[11] 4,148,547

[45] Apr. 10, 1979

[54] FEMALE ELECTRICAL CONTACT

[75] Inventors: Tomonari Otsuki; Akio Yamada, both of Tokyo; Yoshiaki Igarashi, Ichikawa; Hiromasa Inouye, Musashino, all of Japan

[73] Assignee: Bunker Ramo Corporation, Oak Brook, Ill.

[21] Appl. No.: 847,356

[22] Filed: Oct. 31, 1977

Related U.S. Application Data

[63] Continuation of Ser. No. 711,755, Aug. 4, 1976, abandoned.

[30] Foreign Application Priority Data

Aug. 6, 1975 [JP] Japan ..... 50-108095[U]

[51] Int. Cl.[2] ..... H01R 13/12

[52] U.S. Cl. ..... 339/258 R

[58] Field of Search ..... 339/256 R, 258 R, 258 A, 339/258 C, 258 P, 258 T, 259 R

[56] References Cited

U.S. PATENT DOCUMENTS

| | | | |
|---|---|---|---|
| 3,363,224 | 1/1968 | Gluntz | 339/258 R |
| 3,566,342 | 2/1971 | Schmitt et al. | 339/258 P |
| 3,824,557 | 7/1974 | Mallon | 339/17 CF |
| 3,836,947 | 9/1974 | Yeager | 339/259 R |

FOREIGN PATENT DOCUMENTS

| | | | |
|---|---|---|---|
| 2036990 | 2/1971 | Fed. Rep. of Germany | 339/258 R |

*Primary Examiner*—Joseph H. McGlynn
*Attorney, Agent, or Firm*—F. M. Arbuckle; T. G. Scavone

[57] ABSTRACT

A female electrical contact for making electrical contact with a mating male pin contact. The female contact is formed from a single piece of sheet metal and includes a pair of opposed contact leaves encased in the end of a tubular member of rectangular cross section. The tubular member has a closed end with a small aperture at its center, opening into between the two opposing contact leaves. The base for the contact leaves is U-shaped and has a pair of tabs which are bent to retain one of the rectangular faces of the tubular member in firm fixed position. The closed end may be concave to provide a camming action for the male pin to be inserted in the aperture therein. Additionally, a terminal strip portion can be provided extending from the U-shaped face to provide connection for an external conductor. Opposite sides of the tubular member can be foreshortened to bear against the two leaves to aid in biasing the leaves inwardly toward one another. If desired, the entire contact, with the exception of the terminal and closed end, can be encapsulated in a plastic cover layer by a dipping process or by insertion of a shrinkable plastic tubing over the contact. The contact can be used either singly or in a multi-contact connector block.

7 Claims, 12 Drawing Figures

Fig.5a.
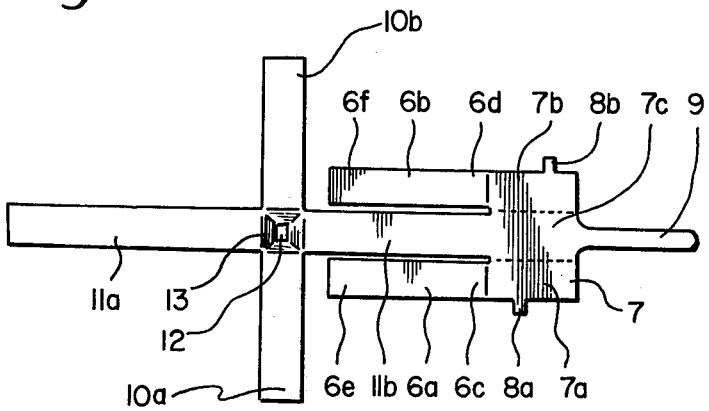
Fig.6a.
(PRIOR ART)
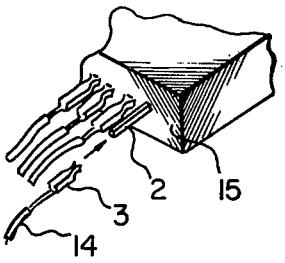
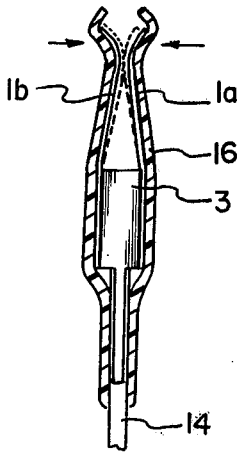
Fig.5b.
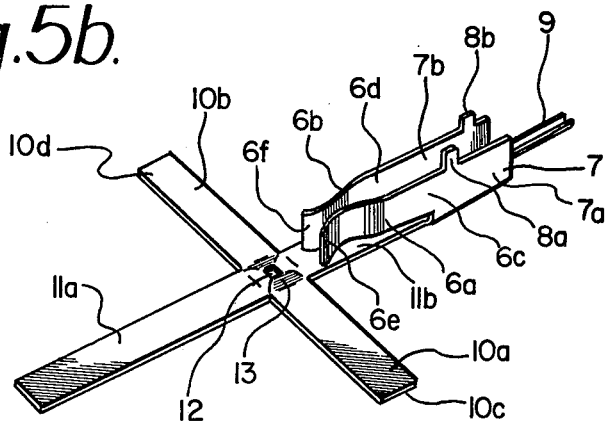
Fig.6b.
(PRIOR ART)
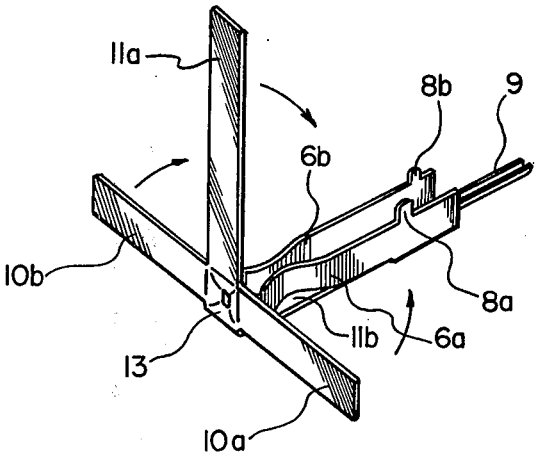
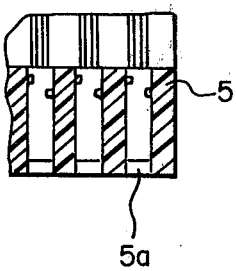
Fig.5c.
Fig.7.

FEMALE ELECTRICAL CONTACT

This is a continuation application of application Ser. No. 711,755, filed Aug. 4, 1976, now abandoned.

BACKGROUND OF THE INVENTION

1. Field of the Invention

This invention relates to a female electrical contact for use as an electrical connector or as one contact of a multi-contact electrical connector.

2. Description of the Prior Art

Female contacts for use either as a single contact or in a multi-contact connector block are well-known in the art. They are generally configured in a U-shape with the arms of the U extending in a direction axially of the contact and bent toward one another for receiving a mating male contact pin. Occasionally, the male contact pin may be incorrectly inserted so as to push one of the contact leaves away from the axis of the contact, and if the elastic limit thereof is exceeded, the contact becomes useless.

Additionally, it is possible with certain prior art contact assemblies to insert the male pin at an angle and thereby cause the pin to pass out of between the opposing leaves and again deforming or damaging the contact, giving rise to a faulty contact which may be difficult to locate, especially if the electrical connection is intermittent between the male and female parts.

When prior art contacts of the type described above are encapsulated with a shrinkable tubing sleeve, upon shrinking of the sleeve the leaves are drawn together thereby preventing any reliable insertion of the mating male contact pin. To avoid this, a separate tubular member has been inserted over prior art contacts of the type described, and while all of the above-mentioned deficiencies can be avoided by such construction, the resulting contact is a two-piece contact which undesirably increases manufacturing costs, assembly costs, and complicates ordering and storage considerations.

When female contacts of the type described are used as individual contacts of a multi-contact connector insulator block, a narrowing at the front of the contact receiving channel is necessary in order to ensure that the male contact pin is guided to between the opposing leaves in a reliable fashion. This increases the tooling and cost of producing the connector insulator block.

SUMMARY OF THE INVENTION

It is therefore an object of the invention to provide a simple, low cost, one-piece female electrical contact.

A further object of the invention is to provide a female contact of the type described above which is not affected in its utility as a result of encapsulating the contact with shrinkable plastic tubing.

It is another object of the invention to provide a female electrical contact which, in a single-piece construction, provides positive guiding of a mating male contact pin to between the opposing female contact leaves.

It is yet a further object of the invention to provide a female electrical contact which can be inserted in uniform contact receiving channels of a multi-contact connector insulating block without necessitating a narrowing of the channels.

According to the invention, there is provided a single-piece female electrical contact for making electrical contact with a mating male pin contact. The female contact is formed from a single piece of sheet metal and includes a pair of opposed contact leaves enclosed in the end of a tubular member of rectangular cross section. The tubular member has a closed end with a small aperture at its center opening into between the two opposing contact leaves. The base for the contact leaves is U-shaped and has a pair of tabs which are bent to retain one of the rectangular faces of the tubular member in firm fixed position. The closed end may be concave to provide a camming action for the male pin to be inserted in the aperture therein. Additionally, a terminal strip portion can be provided extending from the U-shaped face to provide connection for an external conductor. Opposite sides of the tubular member can be foreshortened to bear against the two leaves to aid in biasing the leaves inwardly toward one another. If desired, the entire contact, with the exception of the terminal and closed end, can be encapsulated in a plastic cover layer by a dipping process or by insertion of a shrinkable plastic tubing over the contact. The contact can be used either singly or in a multi-contact connector block.

More specifically, the female electrical contact according to the present invention is provided with a U-shaped contact base having a pair of flat parallel opposing legs and a flat connecting bridge portion extending between the opposing legs. A pair of opposing contact leaves extend generally parallel to one another from respective opposed edges of the legs of the U-shaped contact base, the contact leaves having slightly inwardly bent portions adjacent their free ends for making electrical contact with a captured male pin inserted therebetween. Integral with the U-shaped contact base and the pair of opposing contact leaves is a tubular member of rectangular cross section having a closed end and an opened end and receiving the free ends of the pair of opposing contact leaves. The closed end wall of the tubular member has an aperture therethrough leading to between the free ends of the pair of opposing leaves, and one of the rectangular sides of the tubular member extends to and joins integrally with the flat connecting bridge portion of the contact base in a common plane. An opposite rectangular side of the tubular member extends lengthwise to adjacent the ends of the U-shaped contact base, and a pair of tabs projecting from the end edges of the U-shaped base are bent over to retain such other rectangular side in a tight fixed position.

The other two opposing rectangular sides of the tubular member are shortened with respect to the two first-mentioned rectangular sides so as to be able to be bent inwardly of the contact structure and apply a biasing force against the contact leaves and thereby aid in producing a desirable high contact pressure against an inserted male contact pin. A terminal strip can extend integrally from the bridge portion of the U, and if desired, the closed end wall of the tubular member can be depressed so as to provide a camming surface, or surfaces, for guiding the male contact pin positively into the aperture provided therein.

BRIEF DESCRIPTION OF THE DRAWINGS

The invention will now be described in detail with reference to the accompanying drawings representing a preferred embodiment of a female electrical contact according to the present invention. In the drawings:

FIG. 5*a* is a plan view of the female electrical contact of FIG. 4 prior to being subjected to a bending operation to produce the final form of the contact;

FIG. 5*b* shows the contact of FIG. 5*a* after a first bending operation;

FIG. 5*c* shows the contact of FIG. 5*b* after a further bending operation, and shows the necessary bends to make to complete the basic contact configuration;

FIG. 6*a* is a perspective view of a plurality of prior art female electrical contacts receiving mating male contact pins;

FIG. 6*b* shows a cross-sectional view of a prior art female electrical contact encapsulated with plastic shrinkable tubing;

FIG. 7 shows a cross-sectional view of a multi-contact insulating connector block having contact receiving channels receiving female electrical contacts according to the present invention.

DESCRIPTION OF THE PREFERRED EMBODIMENT

Figure 1A:
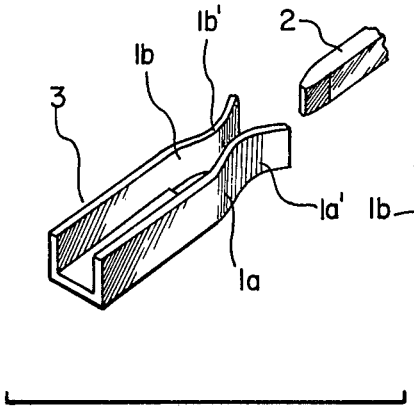
Fig.1a. (PRIOR ART)
FIG. 1*a* is a perspective view of a prior art female electrical contact.
Figure 1B:
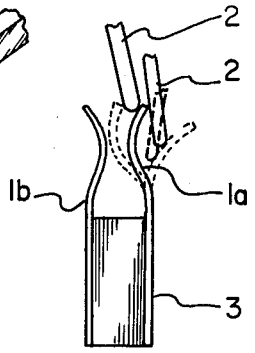
Fig.1b. (PRIOR ART)
FIG. 1*b* is an elevation view of a prior art female electrical contact showing possible faulty connection with a mating male contact pin.

As shown by way of example in the perspective view of FIG. 1*a,* female electrical contacts of the prior art have contact leaves 1*a,* 1*b* facing one another, and connection is made by pushing a mating male contact pin 2 in between the curved portions 1*a'*, 1*b'* near the tips of the contact leaves. It often occurs, as is shown in FIG. 1*b,* that the male contact pin 2 is incorrectly inserted, so as to push one of the contact leaves 1*a* to the side. Depending upon the manner in which the male contact pin 2 is inserted (two incorrect positions in FIG. 1*b*), the tip of one of the leaves 1*a* may be pushed outwardly at an angle from inside so that it is bent to the right as seen in FIG. 1*b,* and if its elastic limit is reached, the leaf will not spring back, and the contact will be made useless.

Alternatively, when the male pin 2 is pushed in and does not enter in between the leaves, the contact leaf 1*a* will be pushed too far inwardly toward the other contact leaf and again may become deformed or damaged giving rise to a faulty contact which may be difficult to locate, as previously noted.

Figure 2:
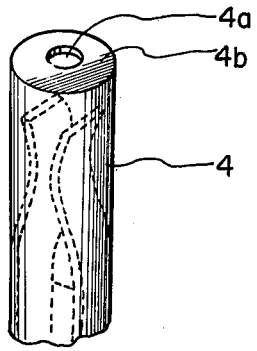
Fig.2. (PRIOR ART)
FIG. 2 is a perspective view of a prior art female electrical contact enclosed in a tubular sleeve.

When it is desirable to make a single contact connector using a female contact constructed according to the prior art shown in FIG. 1*a,* it is often inserted in a tubular sleeve 4 such as shown in FIG. 2, the tubular sleeve 4 having a closed end wall 4*b* with a guide hole 4*a* leading to between the free ends of the female contact leaves. By means of the guide hole 4*a,* the male contact pin is positively prevented from being incorrectly inserted so that it will not push one contact leaf to one side, while at the same time it prevents bending of a contact leaf outwardly beyond its elastic limit. Thus, such an expedient prevents deformation of a contact leaf due to an improperly applied force. In those applications in which the female contacts are used in a multi-contact connector, as shown in the perspective drawing and cross-section drawings of FIGS. 3*a* and 3*b,* respectively, guide holes 5*b* are provided in the face of the connector block, the guide holes 5*b* extending a short distance inwardly of the face of the insulating block and then expanding to normal contact retaining slots 5*a* in the insulator block 5, in which contact retaining slots the female contacts 3 are fixed.

Figure 3A:
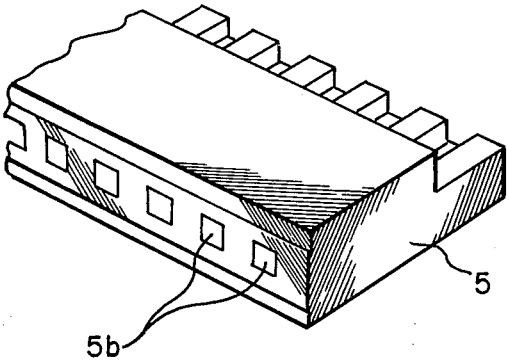
Fig.3a. (PRIOR ART)
FIG. 3*a* is a perspective view of a prior art multi-contact connector insulating block.
Figure 3B:
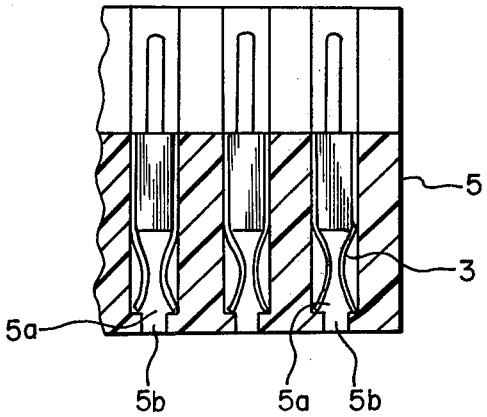
Fig.3b. (PRIOR ART)
FIG. 3*b* is a cross-sectional view of the prior art connector block according to FIG. 3*a;*

However, in the type of construction described above, in which the female contact is housed in a tubular sleeve 4 provided with a guide hole 4*a* in the end wall 4*b* of its tip, and in assemblies such as shown in FIG. 3*a* which necessitate guide holes in the face of the insulator connector block, the excessive costs and manufacturing problems previously noted become prohibitive for certain applications.

Figure 4:
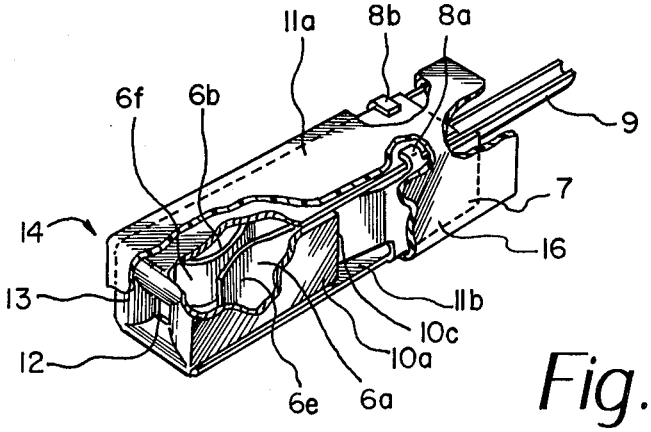
FIG. 4 is a perspective view of a complete female electrical contact according to the present invention.

The perspective drawing of FIG. 4 shows a completed female electrical contact according to the present invention, while FIGS. 5*a*–5*c* show the form of the female contact in its various intermediate configurations during the bending operation to form the completed contact.

With particular reference to FIGS. 4 and 5*a*–5*c,* it can be seen that the finished female contact can be produced from a single sheet of metal appropriately stamped and bent to form the final contact. A U-shaped base plate 7 has a pair of flat parallel opposing legs 7*a,* 7*b* and a flat connecting bridge portion 7*c* joining the lower edges of the opposing legs.

Integral with the contact face 7 is a pair of opposing contact leaves 6*a,* 6*b* of identical, but mirrored, symmetry extending generally parallel to one another from respective opposed edges of the legs 7*a* and 7*b.* The base portions 6*c,* 6*d* of the contact leaves are merely extensions of the legs 7*a,* 7*b,* respectively. The tips 6*e,* 6*f* of the contact leaves are bent to curve inwardly adjacent the free ends of the contact leaves and then again outwardly at the extremities of the leaf tips 6*e,* 6*f,* . The inwardly bent portions near the tips of the contact leaves 6*a,* 6*b* are opposite one another and are positioned to make electrical contact with and capture a male pin inserted therebetween.

As best viewed in FIG. 4, a tubular member 14 of rectangular cross-section, and preferably of substantially square cross-section, encloses the pair of contact leaves 6*a,* 6*b* with the tips 6*e,* 6*f* of the leaves being adjacent the closed end 13 of the tubular member. The closed end 13 acts as a male contact guide plate, and may be concavely depressed as shown in FIG. 4 toward the opening 12 which serves as a male contact guide hole. The guide hole 12 leads directly to between the free ends of the pair of opposing leaves 6*a,* 6*b,* and as best seen in FIGS. 5*a* and 5*b,* the lower rectangular side 11*b* of the tubular member extends to and joins integrally with the flat connecting bridge portion 7*c* of the U-shaped base 7 in a common plane.

A second rectangular side 11*a* of the tubular member 14 extends to between the end edges of the pair of opposing legs 7*a* and 7*b.* A pair of tabs 8*a* and 8*b* project from the edges of the legs 7*a* and 7*b,* respectively, as short extensions of the opposing legs, the tabs 8*a* and 8*b* being bent over opposite lateral edges of the second rectangular side 11*a* to retain the same in a firm, fixed position.

The aperture 12 is centered in the closed end 13 and may, for ease of stamping and forming, but of square configuration.

The pair of opposing rectangular sides 10*a* and 10*b* of the tubular member 14 lie substantially in the plane of the pair of opposing legs 7*a* and 7*b* of base plate 7 having their free end portions 10*c* and 10*d*, respectively, bearing against the outer respective surfaces of the leaves 6*a* and 6*b* for aiding in biasing the leaves toward one another.

Projecting from the bridge portion 7*c* of the base 7 and in the plane thereof is a connector terminal strip 9 which may be advantageously formed as a U-shaped channel for receiving a conductor that is either crimped or soldered in the channel. When the female contact is being used as a single contact connector, it may be provided with an external insulative layer 16 which encapsulates the contact with only the closed end 13 and the terminal strip 9 exposed. The plastic insulating layer can be applied by a dipping process or by shrinking a plastic shrinkable tubing therearound.

In this connection, FIG. 6*a* shows a multi-fingered connector 15 having a plurality of male contact pins 2 projecting therefrom, each contact pin 2 being received in a prior art form of female electrical contact in the form of FIG. 1*a* with a conductor 14 attached to each contact. This figure shows the necessity for providing some form of plastic or other type of insulation about each female contact to avoid shorting adjacent female contacts together.

FIG. 6*d* shows a cross-sectional view of a prior art female contact with plastic shrinkable tubing applied as a sleeve about the contact. As can be observed, using the prior art type of female contact, the contact leaves 1*a* and 1*b* may be pushed by forces as indicated by the arrows in FIG. 6*b* which are created during the heat-shrinking process of the plastic shrinkable tubing 16. As a result, the contact leaves 1*a* and 1*b* are deformed by being forced inwardly as shown by the dotted lines in FIGS. 6*b* so that it becomes difficult or impossible to insert a male contact pin.

The female electrical contact according to the present invention can be produced from a single sheet of metal by means of common industrial punching and bending procedures and results in a contact design which carries its own male contact guide hole 12 and a square tubular member 14 which encloses the contact leaves, thereby making it unnecessary to fix the contacts within a separate tubular sleeve and renders it easily adaptable to protection by insulation encapsulation. Other advantages, as noted, include additional biasing forces for the contact leaves due to the action of the rectangular sides 10*c* and 10*d*, whereby even a small contact can be made to exert a large amount of contact pressure on the male contact pin. When used in a multi-contact connector block, the contact receiving slots can be made of uniform cross section throughout their lengths to simplify manufacturing processes for the contact block. The single-piece configuration is also readily adaptable to large-scale production using a single machine of large capacity.

Thus, from the foregoing, it can be readily realized that this invention demonstrates substantial advancement in the art of manufacturing female electrical contacts. It can also be appreciated that the invention can assume various embodiments. Accordingly, it is to be understood that the invention is not limited to the specific embodiments described herein, but is to be limited only by the appended claims.

The embodiments of the invention in which an exclusive property or privilege is claimed are defined as follows:

1. A single piece female electrical contact comprising:

a U-shaped contact base having a pair of flat parallel opposing legs and a flat connecting bridge portion;

a pair of opposing contact leaves integral with said base and extending generally parallel to one another from respective opposed edges of said opposing legs, said contact leaves having inwardly bent portions for capturing a male pin inserted therebetween; and a tubular member of generally rectangular cross section enclosing said pair of leaves and including a pair of opposing generally rectangular side members substantially in the respective planes of said pair of opposing contact leaves and bearing against the outer surfaces of said contact leaves for biasing said leaves toward each other; a third generally rectangular side member extending to and joining integrally with said flat connecting bridge portion in a common plane; a fourth generally rectangular side member disposed opposite said third side member and extending to and between the edges of said opposing legs; and means integral with said opposing legs for retaining said fourth side member in a relative fixed position; and further including a closed end and an open end, said closed end having an aperture therethrough leading to and between the free ends of said pair of opposing leaves.

2. The contact as claimed in claim 1 wherein said means for retaining said fourth side member in a relatively fixed position comprise a pair of tabs projecting as short extensions of said opposing legs, said tabs being bent over opposite lateral edges of said fourth rectangular side member.

3. The contact as claimed in claim 1 including a plastic insulating layer encapsulating said contact, with only said closed end and said terminal strip exposed.

4. The contact as claimed in claim 1 in combination with an insulating connector block having a plurality of channels for receiving contacts.

5. The contact as claimed in claim 1, including a terminal strip extending from said bridge portion opposite said third generally rectangular side member.

6. The contact as claimed in claim 1, wherein the aperture in said closed end is square and is at a distance from the inwardly bent portions of said leaves to insure that an inserted male pin will pass between said leaves.

7. A single piece female electrical contact comprising:

a contact base having a pair of flat parallel opposing legs;

a pair of opposing contact leaves integral with said base and extending generally parallel to one another from respective opposed edges of said opposing legs, said contact leaves having inwardly bent portions for capturing a male pin inserted therebetween;

a one piece tubular member formed as an integral part of said contact base for substantially enclosing said pair of opposing contact leaves and maintaining contact pressure between said leaves and a male contact inserted therebetween, said tubular member including a first pair of opposing side members extending substantially along the length of and in the respective planes of said pair of opposing contact leaves and bearing against said contact leaves to bias said leaves toward each other;

a second pair of opposing side members extending along the length of said contact leaves in planes substantially perpendicular to the planes of said contact leaves to thereby define together with said first pair of side members a generally rectangular enclosure for said contact leaves;

said generally rectangular enclosure further including a closed end having an aperture formed therein to direct a male contact between said contact leaves; and means for retaining said second pair of side members in a relatively fixed position including tab members projecting as short extensions of said first pair of opposing side members and oriented to overlap opposite lateral edges of at least one member of said second pair of opposing side members.

* * * * *